United States Patent [19]

Reimers

[11] Patent Number: 4,975,817

[45] Date of Patent: Dec. 4, 1990

[54] LOCKING CARRIAGE MECHANISM FOR A LAMP

[75] Inventor: Robert Reimers, Gardner, Kans.

[73] Assignee: Schroer Manufacturing Company, Kansas City, Mo.

[21] Appl. No.: 487,666

[22] Filed: Mar. 2, 1990

[51] Int. Cl.[5] ..... F21V 21/34

[52] U.S. Cl. ..... 362/418; 362/385; 362/804

[58] Field of Search ..... 362/233, 285, 286, 371, 362/386, 418, 430, 804

[56] References Cited

U.S. PATENT DOCUMENTS

| | | | |
|---|---|---|---|
| 2,919,098 | 12/1959 | Mull et al. | 362/272 X |
| 3,818,217 | 6/1974 | Hetz | 362/131 |
| 4,097,919 | 6/1978 | Bobrick et al. | 362/270 |
| 4,517,632 | 5/1985 | Roos | 362/389 |
| 4,538,214 | 8/1985 | Fisher et al. | 362/147 |

*Primary Examiner*—Stephen F. Husar

*Attorney, Agent, or Firm*—Wm. Bruce Day

[57] ABSTRACT

A lamp assembly for surgery and the like includes a ceiling mounted track having opposed internal channels, a carriage assembly that rides in the track and that is connected to a depending tubular stem which terminates in a control head having a lighthead fastened to it. A switch on the control head energizes a solenoid having a movable core that acts through mechanical linkage to retract a pair of opposing brakes from engagement against the side walls of the track, thereby allowing the lamp assembly to be moved along the track easily. When the solenoid is de-energized, a compression spring urges the brakes firmly against the side walls of the track, locking the light assembly in place along the track.

9 Claims, 2 Drawing Sheets

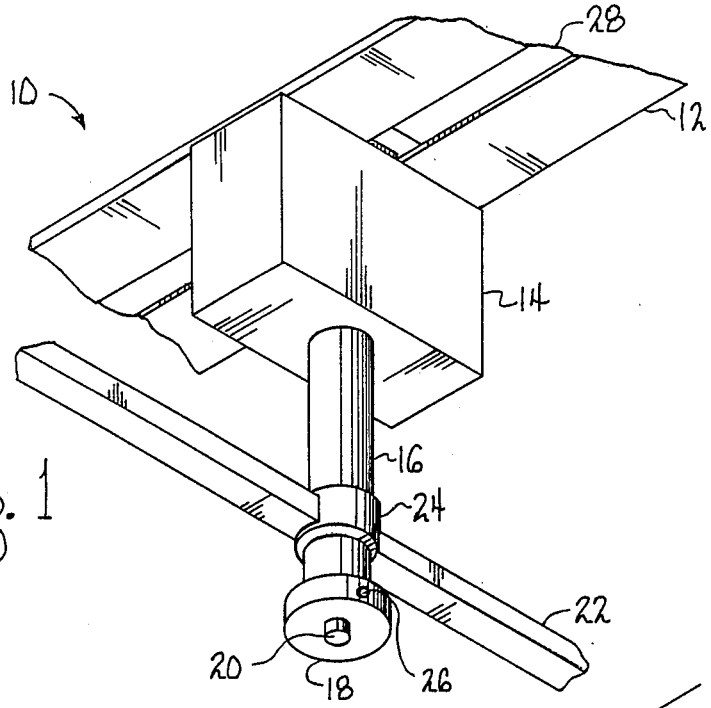
Fig. 1
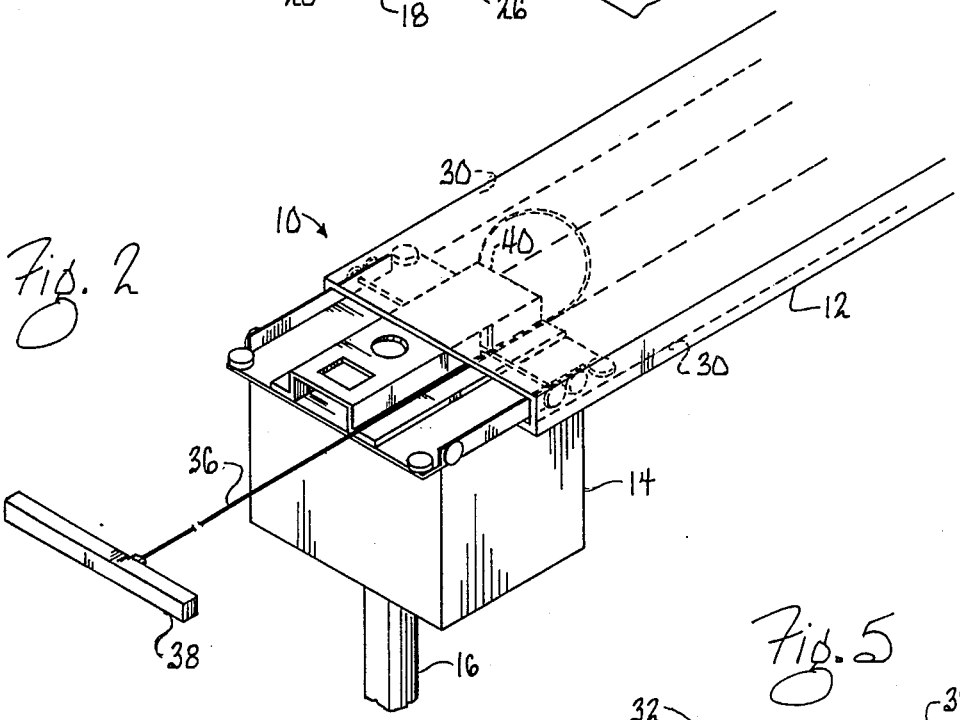
Fig. 2
Fig. 5
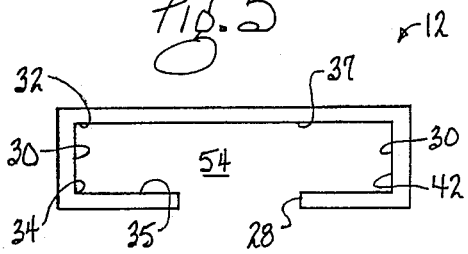

LOCKING CARRIAGE MECHANISM FOR A LAMP

BACKGROUND OF THE INVENTION

1. Field of The Invention

The present invention is directed to a locking carriage mechanism for a lamp, such as an operating or surgical lamp or light. More particularly, the present invention is directed to a lamp or light carriage mechanism that rides on a track that may be mounted on the ceiling.

2. Related Art

It is often necessary to move a light source such as an electric light within a room or other space to provide lighting where it is most needed. One response to this desire for portability is found in track lighting, which as found application in many residential and commercial uses.

Similarly, in operating rooms or theaters, it is frequently desired to move a light source to a specific location dictated by the positioning of the surgical apparatus and the patient. Numerous apparatus for allowing lighting fixtures to be moved about the room have been designed in response to this need. Among them is a longitudinal track running along at least a portion of the ceiling of the operating room and a carriage mechanism for engaging the track an allowing the light assembly to slide along it.

If insufficient friction exists between the track and the carriage mechanism, the position of the light will be difficult to control and may change when the surgeon has not touched it, through vibration in the building for example. To overcome this difficulty, the prior art developed additional frictional engagement means for increasing the friction between the track and the carriage mechanism. Typically, spring-loaded pads bearing against portions of the track were employed. Such frictional engaging means increase the force required to move the lamp assembly along the track. Once the lamp assembly is put in motion it can be moved with some effort, but the excess drag caused by the frictional engagement means does not go away. Surgeons have found the excess force required to move such a light to be a disadvantage and to present difficulty during surgery.

Accordingly, there is a need for a surgery light carriage mechanism and track assembly that can be moved along a track by application of very little force and that can be positively locked in place at the desired location along the track after adjustment of the position.

SUMMARY OF THE INVENTION

Accordingly, it is the primary object of the present invention to provide an overhead surgery lamp or assembly that can be easily moved along a track by application of very little force.

It is a further object of the present invention to provide and overhead surgery lighting assembly that can be positively locked in place at the desired location along the track after adjustment of the position of the lamp or lighting assembly.

These and other objects of the present invention are achieved by providing a locking carriage mechanism for a lamp comprising a lamp mounting unit including means for mounting a lighthead; a carriage attached to the top of the lamp mounting unit and slidably mounted in a track, which is mounted on the ceiling. The locking carriage further comprises means for normally locking the carriage into position in the track by frictional engagement of the track and a means for releasing the locking means through action of an operator or the surgeon, whereby the position of the carriage and lamp mounting unit can be easily adjusted along the track.

The mounting unit further comprises a housing adapted for slidable movement in a track, a stem depending from the housing, and a means for mounting the lighthead attached to the stem at the end opposite of the housing. The stem typically comprises a tubular stem for allowing electrical wires to be routed through it. The carriage resides within the housing and is slidably mounted within the track, which typically includes two opposed longitudinal channels, or recesses. The locking means includes a mechanical means comprising a pair of substantially opposed brakes that are urged outwardly against the opposing longitudinal channels of the track by a compression spring and the releasing means further comprises electro-mechanical releasing means including a solenoid having a movable core connected to the breaks by linkage that acts to release the brakes when the movable core is drawn into the solenoid, and a means for activating the solenoid disposed on the lighthead mounting means. That is, a switch or button mounted near the handle that the surgeon uses to adjust the position of the light is depressed, thereby activating the solenoid and drawing the movable core into the solenoid. This action causes each of the opposing two brakes to be drawn away from the side walls of the channels in the track, thereby releasing them.

The frictional engagement of the brakes against the opposed channels of the track keeps the lighting assembly firmly in the desired position along the track. When the brakes are released, however, the carriage glides smoothly and easily because it rides on a plurality of low-friction wheels that rotate about roller bearings near their axles.

These and other objects of this invention will become apparent from the following description taken in connection with the accompanying drawings, wherein is set forth by way of illustration and example, an embodiment of this invention.

BRIEF DESCRIPTION OF THE DRAWINGS

FIG. 1 is a perspective view of a surgery lamp assembly and carriage in a track viewed from below.

FIG. 2 is a perspective view of the light assembly and carriage in a track shown in FIG. 1, viewed from above.

FIG. 5 is an end elevation of the track.

DESCRIPTION OF THE PREFERRED EMBODIMENT

Figure 3:
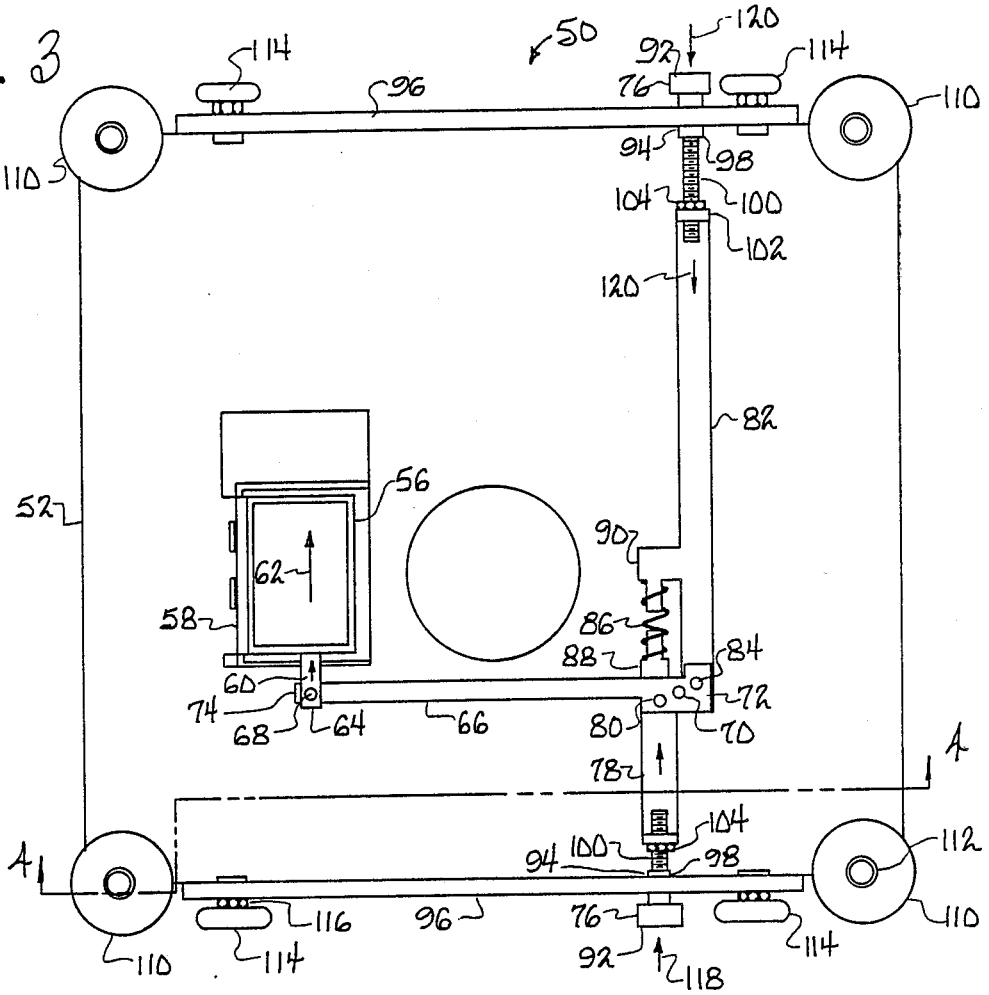
FIG. 3 is a top plan view of the locking mechanism of the light carriage.

As required, a detailed embodiment of the present invention is disclosed herein. It is, however, to be understood that the disclosed embodiment is merely exemplary of the invention, which may be embodied in various forms. Therefore, specific structural and functional details disclosed herein are not to interpreted as limiting, but merely as a basis for the claims and as a representative basis for teaching one skilled in the art to variously employ the present invention in virtually any appropriately detailed structure.

Referring to FIG. 1, there is shown a lamp assembly 10 comprising a track 12, typically mounted on the ceiling of a room, a housing 14 for holding various circuit elements and routing electrical wires, a depending tubular stem 16 connected to the housing 14, and a control head 18, which may include a rheostat 20 for controlling the intensity of the light produced by a lighthead (not shown) that is attached to the control head 18. A handle 22 is attached to the depending tubular stem 16 by the collar 24. The position of collar 24 may be adjusted by the user through means of a set screw (not shown). The handle 22 may be used to rotate the tubular stem 16 about its longitudinal axis to position the light during surgery. A button switch 26 turns the locking mechanism on and off.

Referring to FIG. 2, there is shown a perspective view of the lamp assembly 10 from above. In this view, additional detail of the track 12 can be seen. FIG. 5 provides the best view of several features of the track 12. The track 12 includes a central slot 28, which runs longitudinally the entire length of the track 12, which typically would be about 5 feet to 8 feet long. The track 12 further comprises a pair of opposed track channels, or channels 30 formed by two right angle turns 32, 34 on each of the two opposed sides of the track 12 to form opposing U-shaped channels. The track 12 may be formed through conventional extrusion techniques and the like. Also included are means for delivering electricity to the housing 14 and ultimately to the electric lamps through the track 12. These means are not shown.

Still referring to FIG. 2, there is shown the cable 36, which is fastened to the anchor stop 38, which in turn is fixed to the end of the track. The cable 36 is connected at the end 40 to a ratchet spring mechanism that helps control movement of the housing 14 along the track 12.

Referring to FIG. 5, each channel 30 of the track 14 includes a side wall 42, so that the channel 12 has two opposed parallel channel side walls or side walls 42 against which the brakes 76 bear when the lamp assembly 10 is in the braked or locked position. An outward urging means comprising a compression spring 86 is operatively connected to the brakes 76 through an assembly linkage attached to both brakes 76 and to the compression spring 86, to urge the brakes 76 against the opposed longitudinal side walls 42 in the track 12 channels 30 to maintain the lamp assembly 10 in a normally braked or locked position.

Referring now to FIG. 3, there is shown a plan view of the plate or carriage assembly 50, which includes the carriage plate 52 upon which the carriage hardware is mounted. The carriage plate 52 rides in the interior portion 54 of the track 12 (See FIG. 5). A solenoid 56, designed to operate at 120 volts AC is fixed to the carriage plate 52 by attachment hardware 58. The solenoid 56 includes a movable core 60 of laminated iron, or the like, which is drawn into the solenoid in the direction of the arrow 62 when an electric current flows through the solenoid 56. The plunger or movable core 60 has a protruding end 64, which is fastened to the center link 66 by the roll pin 68 fastened through aligned apertures in the center link 66 and the protruding end 64 of the movable core 60. The roll pin 68 allows for pivotal movement of the two members relative to one another, whereby the angle between the two members can change when the movable core 60 is drawn into the solenoid 56. In a normal, or equilibrium position, these two members are at right angles to one another and lie in substantially the same plane. Naturally, one member must be above and the other below relative to one another but the planes are essentially adjacent, close together, and parallel.

The center link 66 is pivotally mounted on the carriage plate 52 by the roll pin 70, which is adjacent to but displaced from the second end 72 of the center link 66, the first end 74 of the center link 66 being adjacent to the roll pin 68. The roll pin 70 forms a fulcrum about which the center link 66 pivots.

Still referring to FIG. 3, when the center link 66 is pivoted about the fulcrum at the roll pin 70, portions of the center link 66 to the left of the roll pin 70 move in one direction, while portions of the center link 66 to the right of the roll pin or fulcrum 70 move in the opposite direction. This phenomenon is utilized to apply the brakes 76 to the opposed side walls 42 of the track 12, as explained in detail below.

To the left, as illustrated in FIG. 3, of the roll pin or fulcrum 70 along the longitudinal axes of the center link 66 is the short link 78, which is pivotally fastened to the center link 66 by the roll pin 80. To the right of the roll pin or fulcrum 70 and adjacent to the second end 72 of the center link 66, the long link 82 and the center link 66 are fastened together by the roll pin 84, which allows for relative pivotal movement between the two joined members. Thus, the pivot point or fulcrum 70 of the center link 66 is located intermediate, or between, the second end 72 of the center link 66 and the roll pin 80 that attaches the short link 78 to the center link 66. In turn, the short link 78 is attached to the center link 66 at a point between the fulcrum 70 and the first end 74 of the center link 66.

A compression spring 86 is mounted on the compression spring retaining tab 88, which comprises an extension of the short link 78 extending beyond the center link 66. Opposing the tab 88 is the opposed spring retaining tab 90, which is integrally formed with or connected to the long link 82 and is off-set from the long link 82 sufficiently to align with the compression spring retaining tab 88.

The brakes 76 comprise polyethylene caps 92 snapped on over metal feet 98 that penetrate an aperture 94 in the side rails 96 of the carriage 50. The feet 98 further comprise a threaded stud 100 that is adjustably threaded through the nut 102 formed in the short link 78 and the long link 82. A jam nut 104 may be used to tighten the feet 98 into a proper position for the width of a particular track.

Figure 4:
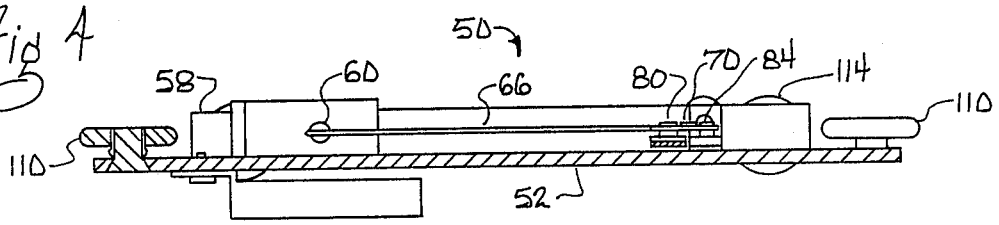
FIG. 4 is a cross sectional view taken along lines 4—4 of FIG. 3.

The carriage 50 includes a number of wheels that revolve upon roller bearing that provide for smooth and easy movement of the carriage 50 along the track 12. The wheels 110 are horizontal when the track 12 is mounted in the ceiling and they travel in the channels 30 of the track 12. The wheels 110 ride on roller bearings 112. The vertically mounted wheels 114 also ride on roller bearings and they bear against the flange 35 portions of the track 12 and against the upper side wall 37 of the track 12. The roller bearings 116 of the vertically mounted wheels 114 are best seen in FIG. 4.

A suitable source of electrical power to the solenoid 56 is switched on and off by the button switch 26 or other convenient means, such as a pressure switch disposed throughout the handle 22. In operation, the surgeon who wants to move the lamp assembly along the track 12 depresses the button switch 26, thereby energizing the solenoid 56. The magnetic field created by the electricity flowing in the solenoid draws the moveable core 60 into the solenoid 56 in the direction of the arrow 62, causing the center link 66 to pivot about the fulcrum 70 clockwise as illustrated in FIG. 3 in an action that draws the short link 78 and the long link 82 both toward the interior portion of the carriage plate 52. That is, as illustrated in FIG. 3, the short link moves in the direction of the arrow 118 and the long link 82 moves in the direction of the arrow 120. The force exerted upon these link members by the solenoid 56 is sufficient to further compress the compression spring 86 and retract the brakes 92 from engagement with the side walls 42 of the track channels 30. Thus, the lamp carriage assembly can be easily moved along the track 12. When the lamp assembly 10 is in the desired location, the surgeon releases the button switch 26, which cuts off the flow of electricity into the solenoid, allowing the compression spring 86 to urge the short link 78 and the long link 82 outward of the interior portion of the plate, that is, to cause the brakes 76 to engage the side walls 42 of the track channels 30, thereby locking the lamp assembly 10 into its then current position on the track 12.

It is to be understood that while certain forms of this invention have been illustrated and described, it is not limited thereto, except and in so far as such limitations are included in the following claims.

What is new and is desired to be protected by Letters Patent is as follows.

1. A locking carriage mechanism for a lamp comprising:

(a) a lamp mounting unit including means for mounting a lighthead;

(b) a carriage attached to the top of said lamp mounting unit and slidably mounted in a track having at least one longitudinal side wall;

(c) a track mounted on a firm surface;

(d) means for locking said carriage into position in said track by frictional engagement with said track; and (e) means for releasing said locking means through action of an operator whereby the position of said carriage and said lamp mounting unit can be adjusted along said track.

2. A locking carriage mechanism as claimed in claim 1 wherein said locking means further comprises a mechanical locking mechanism.

3. A locking carriage mechanism as claimed in claim 2 wherein said mechanical locking mechanism further comprises at least one brake and means for urging said brake against an interior longitudinal side wall of said track.

4. A locking carriage mechanism as claimed in claim 3 wherein said at least one brake further comprises a pair of brakes with one brake bearing against one longitudinal side wall of said track and said other brake bears against an opposed longitudinal side wall of said track and said urging means further comprises a compression spring operatively connected to both said brakes through an assembly linkage connected to each said brake and to said compression spring.

5. A locking carriage mechanism as claimed in claim 1 wherein said releasing means further comprises an electro-mechanical releasing means.

6. A locking carriage mechanism as claimed in claim 5 wherein said electro-mechanical releasing means further comprises an electrical solenoid having a moveable core adapted to retract said locking means from engagement with said track.

7. A locking carriage mechanism as claimed in claim 6 wherein said electro-mechanical releasing means further comprises a solenoid having a moveable core, said solenoid fixed to a carriage plate, said core being pivotally attached to a first end of a center link having two ends, said center link being pivotally attached to said carriage plate at a fulcrum point intermediate said two ends, a short link pivotally attached to said center link at a point intermediate said center link first end and said pivot point, said short link being perpendicular to said center link and lying substantially in the same plane as said center link, said short link having a second end remote from said point of attachment to said center link, said second end of said short link being attached to a brake, a long link having a pivoting end pivotally attached to said center link at a point intermediate said center link pivot point and said second end of said center link, said long link being disposed perpendicular to said center link and parallel to said short link and lying in the same plane as said center link and said short link, said long link having a braking end remote from said pivoting end, said braking end fixed to a brake, a compression spring mounted between a short link spring tab on an end of said short link remote from said brake end and a long link spring tab extending outwardly of said long link into longitudinal alignment with said short link, whereby said brakes are urged into engagement with opposed longitudinal channels of said track by said compression spring, thereby locking said carriage into position until said solenoid is activated, thereby drawing said moveable core into said solenoid and retracting said brakes from engagement with said track channels thereby freeing said carriage for slidable movement along said track until said solenoid is deactivated.

8. A locking carriage mechanism for a lamp, comprising:

(a) a lamp mounting unit comprising a housing adapted for slidable movement in a track, a stem depending from said housing, and means for mounting a lighthead attached to said stem;

(b) a carriage residing within said housing and slidably mounted within said track;

(c) means for mechanically locking said carriage mechanism in place along said track comprising a pair of substantially opposed brakes urged outwardly against opposing channels in said track by a compression spring;

(d) means for electro-mechanically releasing said locking means through action of an operator, said releasing means comprising a solenoid having a moveable core connected to said brakes by linkage that acts to release said brakes when said moveable core is drawn into said solenoid; and p1 (e) means for activating said solenoid disposed on said lighthead mounting means.

9. A locking carriage mechanism for a lamp as claimed in claim 8 wherein said electro-mechanical releasing means further comprises a solenoid having a moveable core, said solenoid fixed to a carriage plate, said core being pivotally attached to a first end of a center link having two ends, said center link being pivotally attached to said carriage plate at a fulcrum point intermediate said two ends, a short link pivotally attached to said center link at a point intermediate said center link first end and said pivot point, said short link being perpendicular to said center link and lying substantially in the same plane as said center link, said short link having a second end remote from said point of attachment to said center link, said second end of said short link being attached to a brake, a long link having a pivoting end pivotally attached to said center link at a point intermediate said center link pivot point and said second end of said center link, said long link being disposed perpendicular to said center link and parallel to said short link and lying in the same plane as said center link and said short link, said long link having a braking end remote from said pivoting end, said braking end fixed to a brake, a compression spring mounted between a short link spring tab on an end of said short link remote from said brake end and a long link spring tab extending outwardly of said long link into longitudinal alignment with said short link, whereby said brakes are urged into engagement with opposed longitudinal channels of said track by said compression spring, thereby locking said carriage into position until said solenoid is activated, thereby drawing said moveable core into said solenoid and retracting said brakes from engagement with said track channels thereby freeing said carriage for slidable movement along said track until said solenoid is deactivated.

* * * * *